United States Patent [19]

Jarzebowicz

[11] Patent Number: 4,817,874

[45] Date of Patent: Apr. 4, 1989

[54] NOZZLE ATTACHMENT FOR ABRASIVE FLUID-JET CUTTING SYSTEMS

[75] Inventor: Richard Z. Jarzebowicz, Kirkland, Wash.

[73] Assignee: Flow Systems, Inc., Kent, Wash.

[21] Appl. No.: 794,234

[22] Filed: Oct. 31, 1985

[51] Int. Cl.[4] ..... B05B 7/04

[52] U.S. Cl. ..... 239/434; 51/439; 239/587; 239/600; 285/24; 285/184

[58] Field of Search ..... 239/310, 318, 434, 587, 239/600; 51/439; 285/184, 24, 27

[56] References Cited

U.S. PATENT DOCUMENTS

| | | | |
|---|---|---|---|
| 935,412 | 9/1909 | Rust | 285/184 |
| 973,558 | 10/1910 | Pierce | 285/184 |
| 2,332,407 | 10/1923 | Spenle | 51/439 |
| 2,440,643 | 4/1928 | Pettinos | 51/439 |
| 2,751,716 | 6/1956 | Pletcher | 51/439 |
| 3,739,451 | 6/1973 | Jacobson | 285/27 |
| 4,139,222 | 2/1979 | Loland | 285/27 |
| 4,478,368 | 10/1984 | Yie | 239/600 |

FOREIGN PATENT DOCUMENTS

| | | | |
|---|---|---|---|
| 392826 | 5/1933 | United Kingdom | 51/439 |

*Primary Examiner*—Andres Kashnikow
*Assistant Examiner*—Michael J. Forman
*Attorney, Agent, or Firm*—Ashen Golant Martin & Seldon

[57] ABSTRACT

An abrasive jet-forming nozzle assembly is disclosed for use in a waterjet cutting system. The nozzle assembly includes a jet-forming orifice for producing a high velocity jet from a highly pressurized water upstream of the orifice, and a discharge tube downstream of the orifice for permitting abrasive particles to become entrained in the jet, and for discharging the abrasive-laden jet against a workpiece. The discharge tube is pivotably movable into alignment with the orifice.

22 Claims, 1 Drawing Sheet

NOZZLE ATTACHMENT FOR ABRASIVE FLUID-JET CUTTING SYSTEMS

This invention relates to a method and apparatus for cutting materials by means of a high velocity fluid jet. More specifically, this invention relates to a method and apparatus for producing a fluid jet which contains abrasive particles.

Cutting by means of a high velocity fluid jet is well known in the art. Typically, a fluid, such as water, at pressures up to 55,000 pounds per square inch is forced through a jewel nozzle having a diameter of 0.003 to 0.030 inches to generate a jet having a velocity of up to three times the speed of sound. The jet thus produced can be used to cut through a variety of metallic and non-metallic materials such as steel, aluminum, paper, rubber, plastics, Kevlar, graphite and food products.

To enhance the cutting power of the fluid jet, abrasive materials have been added to the jet stream to produce a so-called "abrasive jet". The abrasive jet is used to effectively cut a wide variety of materials from exceptionally hard materials such as tool steel, aluminum, cast iron armor plate, certain ceramics and bullet-proof glass to soft materials such as lead. Typical abrasive materials include garnet, silica and aluminum oxide having grit sizes of #36 through #120.

The abrasive is typically added to the fluid downstream from the nozzle opening of the jet-forming nozzle. In practice, an abrasive jet housing containing a mixing region has been mounted on the fluid jet nozzle so that the jet passes through the mixing region and exits from the distal end of the housing. The abrasive jet housing is frequently referred to as a "mixing nozzle", and is mounted as an attachment to the fluid jet nozzle. The fluid jet nozzle is also referred to as the "high-pressure" nozzle.

The abrasive is typically supplied from a nearby hopper to the mixing region by means of an abrasive delivery line in fluid communication with the fluid jet via a conduit in the abrasive jet housing. The abrasive, which is under atmospheric pressure in the hopper, is drawn into the fluid jet by the lower pressure region surrounding the flowing fluid in accordance with the Venturi effect. In operation, quantities of 0.5–3.0 lbs/min of abrasive material have been found to produce a suitable abrasive jet. The abrasive material is accordingly coupled from the hopper to the mixing region through a solenoid-activated valve which regulates the flow rate of the abrasive material into the jet.

After passing through the mixing region, the abrasive jet exits from the mixing nozzle through an outlet passageway. To maximize the life of the mixing nozzle, it is highly desirable to align the abrasive jet and mixing nozzle. Unless its internal fluid path is generally concentric with the abrasive jet, the mixing nozzle wears out quickly and becomes inefficient. Because the fluid path through the abrasive jet housing is several inches long, very minute alignment errors (e.g., a few tenths of a thousandths inch out of perpendicularity) are enough to cause premature failure of the mixing nozzle.

Concentricity and alignment has been difficult to attain for a number of reasons. First, imperfections in the jewels of the high-pressure nozzles cause the path of the fluid jet to deviate from normal by different amounts. Secondly, it is easy to imprecisely install the jewel within its mount, causing further deviation of the fluid jet from its theoretical path. Additionally, normal manufacturing tolerances in the fluid jet nozzle and abrasive jet nozzle can create slight variations in the relationships between the fluid jet path and the path defined by the abrasive jet housing.

In the past, attempts have been made to solve the alignment problem by making the inside diameter of the mixing nozzle very large with respect to the fluid jet diameter, thereby reducing the chance that the jet would impinge on its internal surfaces. Such nozzles have, however, been found to be inefficient in cutting performance.

It is therefore highly desirable that some form of adjustment be provided so that the fluid jet (and, thus, the abrasive jet) can be made concentric with the internal fluid path of the abrasive nozzle jet. Moreover, the adjustment procedure must be sufficiently rapid and simple to permit alignment under practical field conditions, where simplicity and speed are important.

The present invention is directed to a method and apparatus providing such an adjustment. Specifically, a mixing nozzle is described for use in a fluid jet cutting apparatus of the type including a source of high-pressure fluid, a high velocity nozzle having a nozzle opening through which said fluid is directed as a high velocity fluid cutting jet, and a conduit for delivering fluid from said source to the nozzle opening.

The mixing nozzle comprises a housing having an internal mixing region. The housing includes a n upper body member detachably mountable on the high-pressure nozzle and having first conduit-defining means disposed about a first axis in fluid communication with the mixing region and the opening of the high-pressure. The housing further includes second conduit-defining means disposed about a second axis in fluid communication at one end with the mixing region and adapted to communicate with a source of abrasive at its other end.

The housing further includes a second body member having third conduit-defining means disposed about a third axis in fluid communication at one end with the mixing region to discharge a high-pressure jet of fluid-abrasive mixture at the other end. The second body member is mounted for movement with respect to the upper body member to permit general co-axial alignment between the first and third conduit-defining means so that the third conduit-defining means is generally concentric with the fluid jet.

The nozzle attachment additionally comprises fastening means for releasably securing the upper and second body members against relative movement.

Because the mixing nozzle can be easily aligned in the field, the nozzle may be provided with a disposable insert defining the output passageway for the abrasive jet. Since the output passageway is the most susceptible to damage, the inclusion of the insert in a rapidly alignable mixing nozzle greatly minimizes "downtime".

Another aspect of the invention involves the coating of interior components of the mixing nozzle with a protective layer of accumulated abrasive particles during operation of the abrasive jet. Specifically, an abrasive-collecting pocket is formed about the proximal end of the abrasive jet nozzle to cushion the nozzle and surrounding area from non-aligned spray. Further details concerning the invention will become evident in the following Description of the Preferred Embodiment, of which the following Drawing is a part.

BRIEF DESCRIPTION OF THE DRAWING

The sole FIGURE is a sectional view of an abrasive jet nozzle attachment constructed in accordance with the invention.

DESCRIPTION OF THE PREFERRED EMBODIMENT

Figure 1:
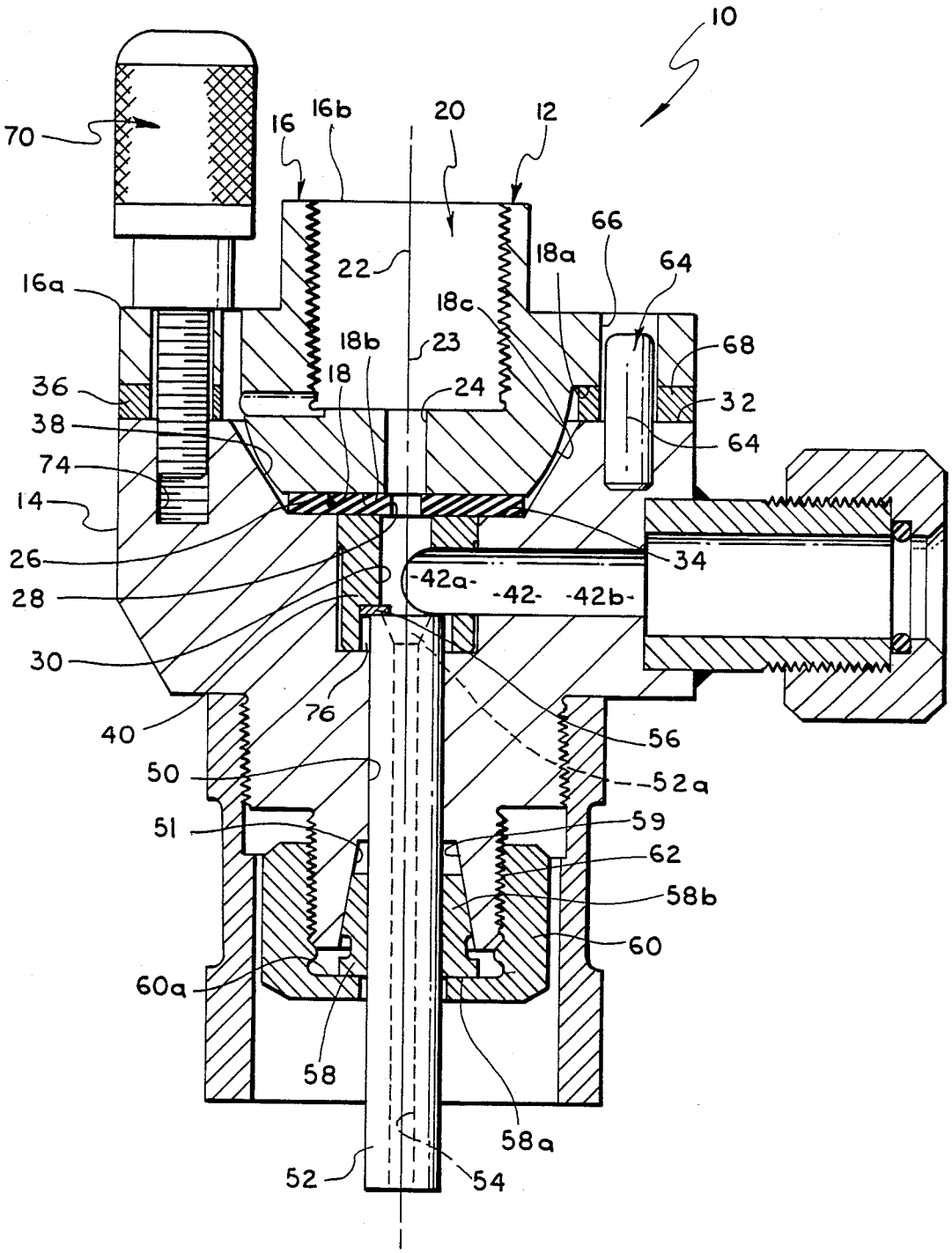

The sole FIGURE is a sectional view of an abrasive jet mixing nozzle constructed in accordance with the invention. The illustrated nozzle 10 includes an upper body member, in the form of a flange 12, which is detachably mountable on a high pressure nozzle. The nozzle 10 also includes a lower body member 14.

The terms "upper" and "lower" are used for consistency with the drawing although those skilled in the art will recognize that this spatial relationship is not necessary to the practice of the invention. Additionally, the terms "proximal" and "distal" are used throughout the specification to denote the relationship of the specified component with respect to the direction of fluid flow; i.e., upstream and downstream, respectively.

The outer face 16 of the flange 12 has a peripheral portion **16*b* and an axially protruding central region, or hub, 16*a* circumventing an internally threaded bore 20. The bore 20 is disposed about an axis 22, and dimensioned to engage external threads on a high velocity fluid jet nozzle. The bore 20 is further dimensioned, and the internal threads positioned, so that the high velocity fluid jet nozzle opening is positioned in the bottom portion of the bore 20 when the flange 12 is tightened onto the fluid jet nozzle. The preferred position of the fluid jet nozzle opening is designated by the numeral 23**.

A fluid passageway 24 extends distally from the first bore 20 and through the inner face 18 of the flange 12. The axis of the passageway 24 is aligned with axis 22 of the first bore 20 and, accordingly, with the fluid jet. The passageway 24 is generally concentric with the fluid jet and is dimensioned so that it circumvents the fluid jet without being impinged thereby.

The inner face 18 of the flange 12 includes a peripheral portion **18*a* and an axially protruding central region 18*b*. An arcuate transition surface 18*c* extends from the periphery region to the central region. For reasons which will become clear below, the arcuate surface is formed about a center of rotation which is generally coincident with the position 23** of the high pressure nozzle opening.

The flange 12 and lower body member 14 are coupled together in a "ball and socket"-like arrangement. The upper face of the lower body member accordingly includes an annular peripheral portion 32 which circumscribes an axially recessed central region 34. A conical transition surface 34 extends generally inward and downward from the peripheral region to the recessed region. The recessed region 34, extended region **18*b*, and transition regions 18*c*,38 form a "ball and socket" like arrangement which permits the lower body member 14 to move angularly with respect to the flange 12**.

The lower body member 14 includes a generally axially extending central bore 50 having a relatively larger diameter segment 30 communicating with the recessed portion 34 of the upper face 32. A hard steel or carbide sleeve 40 fits within the segment 30 and has an internal diameter sufficient to circumvent the fluid jet during operation of the abrasive jet cutting system.

A mixing region is provided within the sleeve 40, where abrasive particles, from a source such as a hopper, become entrained in the fluid jet. Accordingly, the lower body member 14 has a generally radially extending, abrasive-conducting passageway 42 coupling the mixing region within sleeve 40 to a source of abrasive. The internal end **42*a* of the passageway 42 is accomodated by a through-hole formed in the side wall of the sleeve 40. The external end 42*b* of the passageway 42** is adapted to connect to a supply line from the hopper.

Abrasive is drawn into the fluid jet by taking advantage of the Bernoulli principal; namely, that a flowing fluid creates a surrounding region of low pressure. While abrasive in the hopper is subject to atmospheric pressure, the pressure in the mixing region is substantially less than atmospheric when the fluid jet is passing through the sleeve 40. The resulting pressure difference causes abrasive to flow through the passageway 42 and into the mixing region.

A layer 26 of resilient material, such as a one-eighth thick rubber washer, seals the low pressure mixing region from potential leakage through the interface region between the flange 12 and lower body member 14. The layer 26 is positioned between the axially protruding and axially recessed central regions **18*b*,34 and includes a generally central through-hole 28 axially aligned with axis 22** and dimensioned to circumvent the fluid jet without impingement thereby.

The lower segment of the through bore 50 accomodates a generally elongate carbide insert 52 of generally annular cross-section. The interior of the insert 52 provides a passageway 54 through which the abrasive jet is discharged.

In ideal operation, the fluid jet travels axially from the high pressure nozzle opening within bore 20, through the throughhole 28 of layer 26 and into mixing region of sleeve 40, where the low pressure region surrounding the flowing fluid causes abrasive particles from passageway 42 to become mixed with the fluid jet.

The resulting abrasive jet travels axially through the passageway 54 of insert 52 and is discharged at the distal end of the insert 52 to cut material positioned below the mixing nozzle 10.

In practice, carbide inserts two inches long and having 0.250 inch O.D. have been used. In general, the I.D. of the insert should be the sum of twice the O.D. of the abrasive plus the O.D. of the fluid jet. When used in conjunction with a 0.018 inch diameter high-pressure nozzle, an insert having a 0.062 inch I.D. has been found optimum together with #60 grit abrasive. When used with a 0.013 inch diameter high-pressure nozzle, a #0.040 inch I.D. insert together with #80 grit abrasive has produced optimal results.

As previously described, it is highly desirable that the passageway 54 of insert 52 be concentric with the fluid jet to avoid continual and damaging impingement of the cutting jet against one region of the insert's inner wall. In practice it has been found that a non-aligned jet will impart a tear-drop shaped cross-section to the initially round passageway 54, resulting in a loss of cutting efficiency. By contrast, an aligned cutting jet may, at worst, cause a relatively gradual, and symmetrical, enlargement of the insert's I.D. Because the coherency of the jet is not adversely effected by the symmetrical enlargement until the I.D. is substantially enlarged, cutting efficiency is not degraded as rapidly or dramatically.

The illustrated device accordingly provides for the angular adjustment of the abrasive jet passageway 54 to provide for its co-axial alignment with the flow of the water jet along axis 22. A plurality of locating pins 64 are circumferentially disposed about the periphery of the lower body member's upper face 32. The pins 64 extend generally parallel to axis 22 from the lower body member through accommodating holes 66 in the flange. The holes are each disposed about a respective axis which is parallel to axis 22. The pins 64 pass through a generally annular sealing gasket 68, which is positioned between the flange 12 and lower member 14 to prevent entry of foreign matter between the flange and member. The gasket 68 may conveniently be a one-eighth inch thick cushion of rubber or cellular urethane having a density of 20 lbs/cubic foot and experiencing 25% deflection at 15–23 PSI.

The flange 12 and lower body member 14 are brought together by aligning the locating pins 64 and the respective accommodating holes 66. When the flange and body member are brought together, the pins and holes are co-axially aligned owing to a close fit with a clearance of approximately 0.002 inches. Accordingly, axis 22 is generally parallel to the axis 65 of the pins 64 and, therefore, generally parallel to the axis through the mixing region. In practice, three pins spaced apart about axis 22 by 120 degrees have been found sufficient.

Adjustment is subsequently made for any remaining nonconcentricity between the passageway 54 and the fluid jet entering the passageway 24. Three adjustment screws 70 are circumferentially disposed about the flange periphery and separated by 120 degrees. The screws 70 extend through accommodating throughholes in the flange, as well as through the annular sealing gasket 68, and are received by internally threaded bores 74 formed in the lower body member 14.

Fine tuning for concentricity is provided selectively tightening or loosening the screws. For example, tightening of both the flange 12 and body member 14 to be squeezed together and causes the passageway 54 in the abrasive jet nozzle to be angularly displaced in a clockwise direction. The arcuate transition surface **18*c* of flange's lower face accordingly rolls against the conical transition surface 38 of the lower body member 14, in the manner of a ball-and-socket joint. Because the arc of the upper transition surface 18*c* has a center of rotation coincident with the high-pressure nozzle orifice, the lower body member 14 essentially rotates about that center as adjustment screw 70** is tightened or loosened.

By slightly tightening or loosening the screws 70, the passageway 54 can be aligned concentrically with the fluid jet in three dimensions. Alignment of the abrasive jet nozzle is repeated when a new jewel is inserted in the high pressure orifice.

The passageway 54 through the carbide insert 52 is concentric with the insert's outer wall along its length, assuring interchangability of inserts when replacement is needed.

Accordingly, the embodiment is configured so that the insert 52 is slid axially upward along bore 50 in the lower body member 14, until its proximal end **52*a* contacts a generally radially extending pin 56 protruding from the inner wall of sleeve 40. Alternatively, the pin 56 may be omitted, and the end 52*a* of the insert may simply be inserted until it contacts the shoulder of the sleeve. A generally annular chuck-like device, such as collet 58, is slid upward along the insert until it engages the inwardly conical bore 51 at the distal end of the third bore 50. The bottom face 58*a* of the collet 58 is engaged by the inner face of an internally threaded collar 60*a* which is tightened onto the downwardly protruding, externally threaded neck 62 of the lower body member 14. As the collar 60 is tightened onto the neck 62, the fingers 58*b* of the collet 58 are increasingly compressed against the insert 52 by the increasingly narrowing space defined by the inwardly tapering wall 59. Those skilled in the art will recognize that the insert 52 may be conveniently replaced by simply unscrewing the collar 60, sliding the old insert 52 out and inserting a new insert 52** as described above.

The ball-and-socket-type engagement between the upper and lower body members, and the tightened screws 70 prevent the jet and passageway 54 from becoming misaligned during operation.

In accordance with another aspect of the invention, an annular pocket 76 is formed about the proximal end of the insert 52 by providing an oversized bore in the sleeve 40 below the protruding pin. The annular pocket is thereby defined between the O.D. of the insert and the I.D. of the sleeve 40. The space between these two surfaces may conveniently be one-eighth inch to one-quarter inch in diameter. During operation of the abrasive jet, abrasive particles become trapped within the pocket, forming a protective layer which shields the sleeve 40 and insert 52 from erosion.

While the foregoing description includes detailed information which will enable those skilled in the art to practice the invention, it should be recognized that the description is illustrative and that many modifications and variations will be apparent to those skilled in the art having the benefit of these teachings. For example, the function of the locating pins 64 and screws 70 can be combined by means of externally threaded studs.

It is accordingly intended that the invention herein be defined solely by the claims appended hereto and that the claims be interpreted as broadly as permitted in light of the prior art.

I claim:

1. For use in a fluid jet cutting apparatus of the type including a source of high-pressure fluid, a high-velocity nozzle having a nozzle opening through which said fluid is directed as a high-velocity fluid cutting jet, and a conduit for delivering fluid from said source to the nozzle opening, a nozzle attachment for producing as abrasive fluid jet comprising:

a body having an internal mixing region and including, (a) a first body member detachably mountable on the high-velocity nozzle and including a first conduit in fluid communication with the mixing region and the nozzle opening;

(b) an abrasive conduit in fluid communication at one end with the mixing region and adapted to communicate with a source of abrasive at its other end;

(c) a second body member including a second conduit in region to discharge a high-pressure jet of fluid-abrasive mixture at its distal end, the second body member being mounted for pivoting movement with respect to the first body member to permit alignment between the first and second conduits; and (d) fastening means for releasably securing the first and second body members against relative movement.

2. The attachment of claim 1 including means for moving the second body member relative to the first body member so that the distal end of the second conduit pivots about a center positioned at approximately the high velocity nozzle opening when the attachment is mounted on the high velocity nozzle.

3. The attachment of claim 1 or 2 including ball-and-socket surface defining means interjacent the first and second body members for guiding the second body member about the first body member so that the ends of the first and second conduits adjacent the mixing region are relatively pivotable into alignment.

4. The attachment of claim 1 wherein the first conduit is disposed about a first axis, and the first body member includes a distal face having a peripheral region and an axially protruding generally central region disposed about the first axis, and wherein the second body member includes a generally complimentary shaped proximal face maintained in a spaced relationship with the distal face of the first body member, and including means disposed about the first axis for adjustably varying the spatial relationship between selected regions of said proximal and distal faces.

5. The attachment of claim 4 wherein the adjustably varying spatial means includes a plurality of screws extending through the first body member and into the second body member, and thread engaging means responsive to relative rotation of a screw to exert a progressively variable spatial-adjusting force between the two body members.

6. The attachment of claim 4 wherein the axially protruding region of the first body member and the complimentary region of the second body member respectively include first and second contact surfaces interengaged along a line of contact to guide the relative movement of the two body members during variations in the spatial relationship.

7. The attachment of claim 6 wherein the first contact surface is shaped to provide an arcuate movement of the second body portion having a center of rotation approximately at the high pressure nozzle opening when the attachment is mounted on the nozzle.

8. The attachment of claims 4 or 6 wherein the adjustably varying spatial means includes a plurality of screws extending through the first body member and into the second body member, and thread engaging means responsive to relative rotation of a screw to exert a progressively variable spatial-adjusting force between the two body members.

9. The attachment of claims 1, 4, or 6 including a plurality of pin members extending from a selected one of the two body members into the other of the two body members, said other body member having a like plurality of close tolerance accommodating holes dimensioned to receive the pins, thereby providing an initial spatial relationship between the two body members which approximates alignment of the two conduits.

10. The attachment of claim 1 including a generally tubular insert positioned in the second conduit and in fluid communication with the mixing region at its proximal end, and means for releasably retaining the insert in the second conduit.

11. The attachment of claim 10 including a blocking member extending generally transverse to the tubular insert and positioned for insertion-limiting contact with the insert when the insert's leading edge is adjacent the mixing region.

12. The attachment of claim 10 wherein the second conduit includes a distally located, generally distally extending, divergent sidewall region circumventing the insert, and the attachment further includes a generally annular multi-fingered chuck mounted on the insert with its fingers circumferentially disposed thereabout, the chuck being dimensioned to initially loosely circumvent the insert and to slidably engage the sidewall region so that its fingers are urged increasingly inward by the convergance of the sidewall region, and engaging means for urging the chuck along the converging sidewall so that the fingers exert a retaining force on the insert.

13. The attachment of claim 12 wherein the second body member is externally threaded near its distal end, and the engaging means includes a generally annular, internally threaded collar dimensioned to screw onto said distal end and urge the chuck along the converging sidewall.

14. For use with a fluid jet cutting apparatus of the type including a source of high pressure fluid, a high velocity nozzle having a nozzle opening through which said fluid is directed as a high velocity fluid cutting jet, and a conduit for delivering fluid from said source to the nozzle opening, a nozzle for producing an abrasive fluid jet comprising:

(a) a generally axially extending body having a mixing region and formed by a plurality of relatively movable, generally axially extending body segments:

(b) means positioned within one of the body segments for producing a high pressure fluid jet along a jet axis;

(c) a first conduit in fluid communication with the mixing region and the jet producing means;

(d) a second conduit in fluid communication with the mixing region and adapted to communicate with a source of abrasive; and (e) an output conduit positioned in another of the body segments and in fluid communication with the mixing region to discharge a high-pressure jet of fluid/abrasive mixture from the body; and (f) means for adjustably pivoting the body segments into releasably secured alignment of the output conduit with the jet axis.

15. In combination, a first body member having a nozzle-receiving bore disposed about a bore axis and adapted to firmly retain a nozzle within the bore, the first body member further having a fluid passageway communicating at its proximal end with said bore for passing the high velocity fluid jet through the first body member to a distal end of the first passageway, a second body member having a second conduit and mounted to the first body member so that the first and second conduits are generally co-axially aligned in fluid communication and the proximal end of the second conduit faces the distal end of the first conduit;

one of the two body members having a third conduit in fluid communication with the first and second conduits at a mixing region within the combination, the third conduit extending away from the first and second conduits to couple the mixing region to a source of abrasive;

positioning means for positioning the second conduit in approximate alignment with the first conduit during initial assembly of the combination; and, adjustment means for pivotably aligning the first and second conduits into secure alignment.

16. The combination of claim 15 wherein the positioning means includes a plurality of locating pin members radially displaced form, and disposed about, the bore axis, the pin members being held by one of the two body members, and wherein the other of the two body members includes means for receiving the pin-like members to approximately align the first and second conduits.

17. The combination of claim 16 wherein the member-receiving means includes a plurality of member-receiving holes formed in said other of the body members.

18. The combination of claim 17 wherein the members and holes have a close tolerance of approximately 0.002 inches.

19. The combination of claim 15 wherein the adjustment means includes a plurality of threaded shafts extending through one of the body members and at least partially through e other body member, the shafts being radially displaced from and disposed about the bore axis, a resiliently compressible structure positioned between the two body members, and a like plurality of threaded-hole defining members configured to threadably engage the shafts, the hole defining members being adjustably tightened onto respective shafts to essentially align the first and second conduits by varying the spatial relationship between the two body members.

20. The combination of claim 15 or 19 wherein the first body member has a distal facial portion circumventing the distal end of the first conduit, the distal facial portion having an arcuate surface, and wherein the second body member has a proximal facial portion circumventing the proximal end of the second conduit for supporting the distal facial portion of the first body member.

21. The combination of claim 20 wherein said nozzle has a discharge opening, and the arcuate surface of the distal facial portion has a center of rotation generally positioned at the position of the nozzle opening.

22. For use in a fluid jet cutting apparatus of the type including a source of high-pressure fluid, a high-velocity nozzle having a nozzle opening through which said fluid is directed as a high-velocity fluid cutting jet, and a conduit for delivering fluid from said source to the nozzle opening, a nozzle attachment for producing an abrasive fluid jet comprising:

a housing having a proximal and distal faces, a first passageway communicating with the two faces, and a second passageway communicating with the first at a mixing region and extending therefrom to couple the first passageway to a source of abrasive;

a generally elongate, tubular insert positioned within the first passageway and extending distally from the mixing region to define the abrasive jet passageway; and, means for defining an abrasive-accumulating pocket circumventing the proximal exterior of the insert and in communication with the second passageway at the mixing region so that a protective cushion of abrasives is deposited thereabout during production of the abrasive jet.

* * * * *